US006473970B1

(12) United States Patent
Prochaska

(10) Patent No.: US 6,473,970 B1
(45) **Date of Patent: *Nov. 5, 2002**

(54) RAZOR BLADE CARTRIDGE WITH LUBRICATING FLOW PATHS

(75) Inventor: Frank Prochaska, Waynesboro, VA (US)

(73) Assignee: American Safety Razor Company, Verona, VA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/050,174

(22) Filed: Mar. 30, 1998

Related U.S. Application Data

(60) Provisional application No. 60/062,485, filed on Oct. 20, 1997.

(51) Int. Cl.[7] ..... B26B 21/22; B26B 21/40

(52) U.S. Cl. ..... 30/41; 30/50; 30/77; 30/84; 30/527

(58) Field of Search ..... 30/47–50, 346.5, 30/346.57, 346.58, 346.59, 346.61, 41, 77, 84, 526, 527

(56) References Cited

U.S. PATENT DOCUMENTS

| | | | | | |
|---|---|---|---|---|---|
| 3,955,277 | A | * | 5/1976 | Pomfret | 30/47 |
| 4,026,016 | A | | 5/1977 | Nissen | 30/47 |
| 4,063,354 | A | | 12/1977 | Oldroyd et al. | 30/47 |
| 4,170,821 | A | | 10/1979 | Booth | 30/41 |
| 4,270,268 | A | | 6/1981 | Jacobson | 30/47 |
| 4,288,920 | A | * | 9/1981 | Douglass et al. | 30/47 |
| 4,345,374 | A | * | 8/1982 | Jacobson | 30/47 |
| 4,378,634 | A | | 4/1983 | Jacobson | 30/47 |
| 4,442,598 | A | | 4/1984 | Jacobson | 30/47 |
| 4,641,429 | A | * | 2/1987 | Abatemarco | 30/41 |
| 4,833,779 | A | * | 5/1989 | Iten | 30/47 |
| 5,070,612 | A | * | 12/1991 | Abatemarco | 30/50 |
| 5,341,571 | A | | 8/1994 | Prochaska | 30/50 |
| 5,551,155 | A | * | 9/1996 | Prochaska | 30/48 X |
| 5,575,068 | A | * | 11/1996 | Pedersen | 30/47 |
| 5,590,468 | A | * | 1/1997 | Prochaska | 30/50 X |
| 5,661,907 | A | | 9/1997 | Apprille, Jr. | 30/47 |
| 5,666,729 | A | | 9/1997 | Ferraro | 30/50 |

* cited by examiner

*Primary Examiner*—Clark F. Dexter
(74) *Attorney, Agent, or Firm*—McDermott, Will & Emery

(57) ABSTRACT

A blade cartridge including one or more blades fixed between a platform member and a cap member. The blades have apertures that allow lubricants removed from a surface of a shaver by the cutting edge of the blade to be transported through the blade and supplied to the cutting edge of the adjacent blade or to a skin engaging surface of the cap member, whichever the case may be. The apertures in the blades define flow paths that allow lubricants to reach successive cutting edges or skin engaging surfaces, thereby reducing irritation to the shaver. The blades are spaced apart by spacers that are constructed with passages that allow the free flow of lubricant through adjacent flow paths. The cap member includes passages that allow the free flow of lubricating agents through the flow paths to the skin engaging surface of the cap member. This arrangement is especially significant for razor blade cartridges having three blades, where, in conventional razor blade cartridges, the third blade and cap member are likely to encounter dry skin.

26 Claims, 8 Drawing Sheets

RAZOR BLADE CARTRIDGE WITH LUBRICATING FLOW PATHS

This application is based upon Provisional Patent Application serial No. 60/062,485, filed on Oct. 20, 1997.

BACKGROUND OF THE INVENTION

The present invention relates to wet shaving systems of the blade type and more particularly to a shaving system having one or more movable blades positioned within a blade cartridge.

Shavers have long sought a wet shaving system that provides a smooth and comfortable shave without causing annoying cuts and abrasions on the skin of the shaver. With the development of shaving, came the development of lubricating agents to reduce irritation to the skin of the shaver. Typically shavers use some type of lubricating agent on the surface of their skin, such as shaving cream or gel containing emollients, moisturizers, surfactants, wetting agents, thickeners, and film formers, to provide a comfortable shave and reduce the amount of irritation to the skin caused by the razor blade cartridge being repeatedly pulled across the skin of the shaver. However, because conventional razor blade cartridges include blades that strip the lubricating agent from the skin as they are pulled across the skin of the shaver, lubricating agents are only effective on the initial pass of the razor.

Conventional razor blade cartridges remove the lubricating agent from the skin without providing a means for replenishing the agent, and thereby leave the skin dry and vulnerable to irritation from successive passes of the skin engaging edges or surfaces of the blade cartridge. With the development of multi-blade razors, the problem of stripping of lubricants from the skin of the shaver significantly affects shave comfort and promotes higher levels of irritation of the skin. Conventional triple blade cartridges include three blades that individually and successively strip the lubricating agents from the skin of the shaver without providing a means for replenishing the agents. Even on the initial pass of a conventional triple blade razor, the first blade strips the agents and leaves dry skin that is vulnerable to irritation by the cutting edges of both the second and the third blades, and from the skin contacting surfaces of the cap member.

Recently, blade cartridges have been constructed to include lubricating strips mounted on the skin contacting portions of the cap member. Many of these lubricating strips are constructed such that water facilitates the release of the lubricating substance on the lubricating strip. Therefore, the release of the lubricating substance is inhibited by the removal of water from the skin of the shaver by conventional razor blades. The development of a shaving cartridge that includes a means for replenishing moisture to the skin of the shaver after the blade has passed over the skin would enhance the performance of many such lubricating strips.

U.S. Pat. No. 5,661,907, issued on Sep. 2, 1997, to Domenic Apprille, Jr. describes a razor blade assembly including three blades mounted within a housing. The patent to Apprille describes a three blade arrangement where blade 18 will strip a large portion of lubricating agents from the skin of the shaver, leaving each successive blade 20 and 22 and the skin contacting surfaces of the cap member 16 to engage dry skin and thereby cause irritation. The patent to Apprille fails to describe a means for supplying lubrication to the successive blades and the skin engaging surfaces of the cap member. Instead, the invention described in the patent to Apprille channels the lubricating agents between the blades and channels them out the rear of the cartridge. A similar situation arises for the invention disclosed in U.S. Pat. No. 5,666,729, issued on Sep. 16, 1997, to Frank A. Ferraro. The patent to Ferraro describes a shaving system having a first support, at least one resilient support and a plurality of blades arranged in a spaced relationship and supported by the resilient support.

U.S. Pat. No. 5,341,571, issued on Aug. 30, 1994, to Frank H. Prochaska describes a blade cartridge including a platform member 2, a first blade 32, a spacer 6, a second blade 34, and a cap member 8. The first blade 32 and second blade 34 are described as including holes 42 that provide a passage to facilitate the removal of shaving debris. As depicted in FIGS. 1 and 7, the cap member 8 of the Prochaska patent includes a lower surface 72 that extends towards the edge of blade 34 to form a cavity 76. The cap member 8 further includes a plurality of downwardly extending pads on the forward portion of the cap member 8. The Prochaska patent does not describe an effective means for supplying lubrication agents to the skin engaging surface of the cap member. The portion of the cap member 8 that extends to the edge of blade 34 prevents the free flow of lubricants through holes 42 in blade 34 to the skin engaging surface of the cap member 8. Therefore, the lubricant will take the path of least resistance and exit the blade cartridge through slot 26.

Consequently, a need exists for a blade cartridge incorporating an effective means for supplying lubrication agents to the skin engaging surfaces of all blade edges and the cap member. Such a blade cartridge will not only reduce irritation of the skin of the shaver from contact with skin engaging surfaces of the cartridge, but will enhance the performance of lubricating strips positioned on the cap member resulting in a high level of comfort and a close long lasting shave.

SUMMARY OF THE INVENTION

The present invention provides a novel blade cartridge designed to satisfy the aforementioned needs. The invention embodies one or more blades fixed between a platform member and a cap member. The blades have apertures that allow lubricants removed from a surface being shaved by the cutting edge of the blade to be transported through the blade and supplied to the cutting edge of the adjacent blade or to a skin engaging surface of the cap member, whichever the case may be. The apertures in the blades define flow paths that allow lubricants to reach successive cutting edges or skin engaging surfaces, thereby reducing irritation to the shaver caused by each individual blade and skin contacting surface. The present invention includes a cap member having a passage that allows the free flow of lubricating agents through the flow paths and to the skin engaging surface of the cap member. This arrangement is especially significant for razor blade cartridges having three blades, where, in conventional razor blade cartridges, the third blade and cap member are likely to encounter dry skin even during the initial pass of the cartridge over the skin.

Each blade of the present invention has a fixed end and a free, or cantilevered, end. The free end of each blade functions as a single cantilever forming a "flexing zone" about which the cutting edge of the blade bends in response to an applied force. Each blade is flexible about the longitudinal axis of the blade. Thus, the present invention provides for individually movable blades without requiring an elaborate molding procedure to create movable spring fingers or movable blade platforms.

Accordingly, the present invention relates to a blade cartridge including a platform member having a blade seat and a guard member. The guard member is located forward of and parallel to the blade seat so as to form a longitudinal slot between the blade seat and the guard member. The blade cartridge also includes a primary blade that is disposed on the blade seat such that the cutting edge of the blade is located rearwardly of the guard member. The primary blade includes a forward section having an aperture array defining a flow path. A substantial portion of the primary blade extends into the slot formed between the guard member and the blade seat such that the blade is flexible about the longitudinal axis of the blade into the slot. Preferably, the cutting edge of the primary blade is parallel to the guard member.

The blade cartridge also includes a spacer that is located on the upper surface of the primary blade. The spacer includes a rear portion that functions to separate the primary blade and a secondary blade. The spacer also includes a forward portion that extends from the rear portion and has channeling that functions to allow lubricant to flow through the adjacent flow paths.

The blade cartridge further includes a secondary blade that is disposed on the spacer such that the cutting edge of the blade is located rearwardly of the cutting edge of the primary blade. The secondary blade includes a forward section having an aperture array defining a flow path. A substantial portion of the secondary blade extends into the open area formed by the spacer above the primary blade such that the blade is flexible about the longitudinal axis of the blade into the open area. Preferably, the cutting edge of the secondary blade is parallel to the cutting edge of the primary blade.

The blade cartridge also includes a spacer that is located on the upper surface of the secondary blade. The spacer includes a rear portion that functions to separate the secondary blade and a tertiary blade. The spacer also includes a forward portion that extends from the rear portion and has channeling that functions to allow lubricant to flow through the adjacent flow paths.

The blade cartridge further includes a tertiary blade that is disposed on the spacer such that the cutting edge of the blade is located rearwardly of the cutting edge of the secondary blade. The tertiary blade includes a forward section having an aperture array defining a flow path. A portion of the tertiary blade extends into the open area formed by the spacer above the secondary blade such that the blade is flexible about the longitudinal axis of the blade into the open area. Preferably, the cutting edge of the tertiary blade is parallel to the cutting edge of the secondary blade.

The blade cartridge also includes a cap member disposed on the tertiary blade. As mentioned above, the cap member includes channeling that allows the free flow of lubricating agents through the flow paths and to the skin engaging surface of the cap member. The cap member secures the members forming the blade cartridge together. The blade cartridge further includes a lubrication strip integral with the cap member.

As described hereinafter, each blade is independently movable in response to shaving forces applied to the blade. Specifically, each blade is flexible about the longitudinal axis of the blade within a flexing zone defined by the ratio between the portion of the blade overlying a physical structure and the portion of the blade overlying the opening formed beneath the forward portion of each blade, in combination with the physical characteristics of the blade. If a force exceeding the resilient force of the blade is exerted on the blade, the blade flexes about the longitudinal axis so as to bend in the downward direction against the resilient force of the blade. The bending movement of the blade results in the simultaneously decrease of blade exposure and shaving angle.

Preferably, the blade cartridge is connected to a handle, and can be pivotally connected so as to allow the blade cartridge to further respond to shaving forces encountered during the shaving process and orient itself optimally to the surface being shaved.

The invention itself, together with further objects and advantages, will best be understood by reference to the following detailed description taken in conjunction with the accompanying drawings.

BRIEF DESCRIPTION OF THE DRAWINGS

FIGS. 1 though 12 are presented by way of illustration and not limitation to depict the preferred embodiments of the present invention. Embodiments including the various aspects of the present invention will now be described in detail with reference to the accompanying drawings.

DETAILED DESCRIPTION OF THE INVENTION

Figure 1:
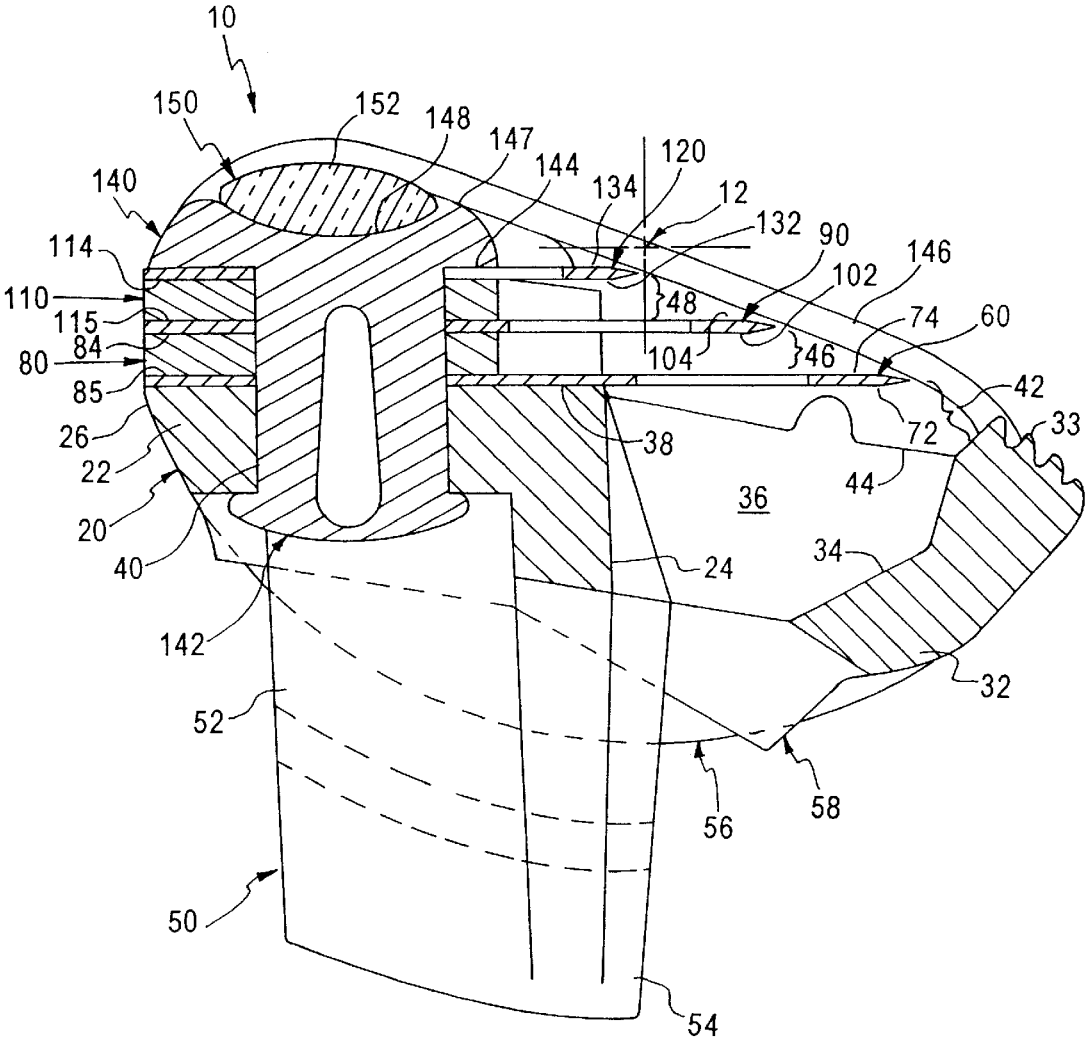
FIG. 1 is a cross-sectional view of the razor blade cartridge of the present invention through a rivet on the cap member illustrating the complete assembly.

Turning now to the drawings, FIGS. 1–12 illustrate a movable blade shaving cartridge ("MBSC" or blade cartridge) or razor head 10 which comprises a platform member 20, primary blade 60, first spacer 80, secondary blade 90, second spacer 110, tertiary blade 120, and a cap member 140.

Figure 9:
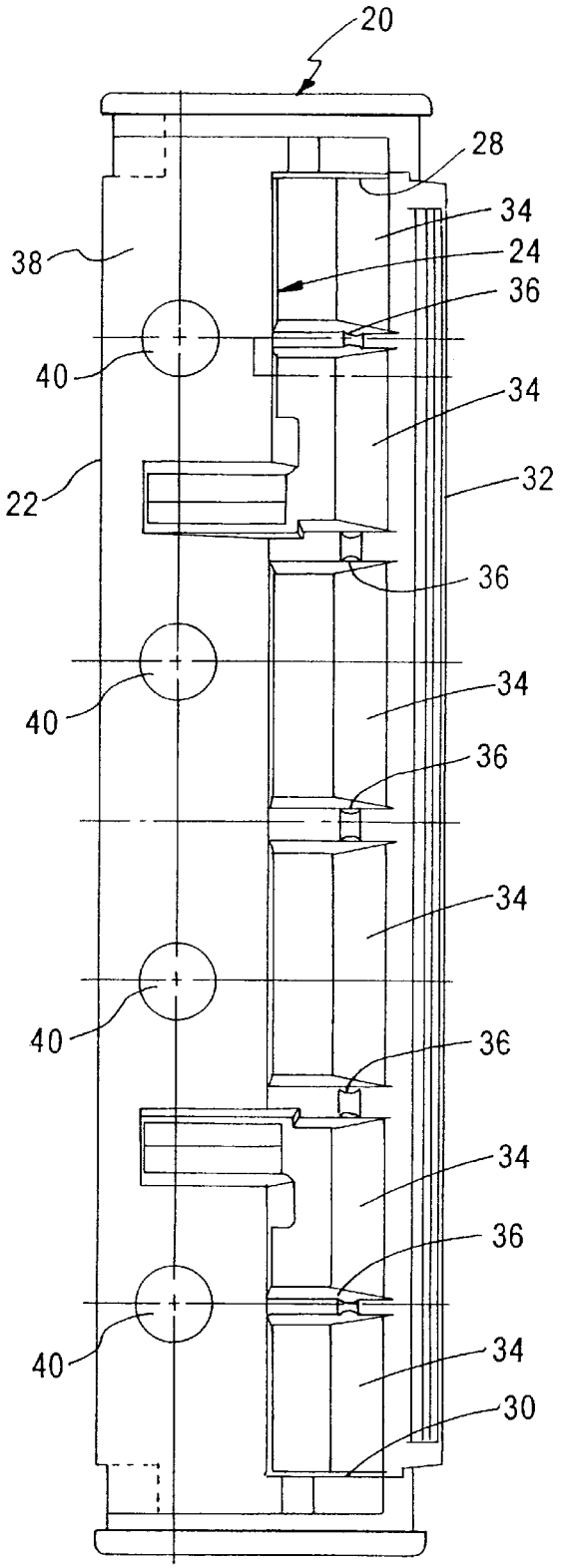
FIG. 9 illustrates a top view of a platform member of the present invention.

As depicted in FIGS. 1 and 9, the platform member 20 includes a blade seat 22 having a front wall 24 and a rear wall 26, and ends 28 and 30 (see FIG. 9). The ends 28 and 30 extend beyond the front wall 24 so as to allow a guard member 32 to be interconnected between the ends 28 and 30 at a position forward of the front wall 24. The guard member 32 extends parallel to the front wall 24 forming a flow channel or slot 34 between the guard member 32 and the front wall 24. The guard member 32 also is connected to the front wall 24 by a plurality of support members 36, which extend substantially perpendicular to the longitudinal axis of the both the guard member 32 and the front wall 24.

The blade seat 22 includes an upper surface 38, as well as a plurality of securing apertures 40. The securing apertures 40 operate in conjunction with staking pins (or rivets) 142 located on the cap member 140 to permanently secure the platform member 20, the blades 60, 90, and 120, the spacers 80 and 110 and the cap member 140 together.

The blade cartridge 10 includes a primary or first blade 60, a secondary or second blade 90, and a tertiary or third blade 120, each having substantially parallel front and rear edges with the front edge of each blade defining a skin engaging edge or cutting edge 62, 92, and 122. Each blade 60, 90, and 120, defines a longitudinal axis that is parallel to the cutting edge of the blade 60, 90, and 120, and a lateral axis that is perpendicular to the cutting edge of the blade 60, 90, and 120. Each blade 60, 90, and 120 is flexible about its longitudinal axis. As described hereinafter, each blade if so desired may be mounted with a flexing zone defined by the ratio between the portion of the blade overlying a physical structure and the portion of the blade overlying the opening formed beneath the forward portion of each blade, in combination with the physical characteristics of the blade. If a force exceeding the resilient force of the blade is exerted on the blade, the blade will therefore flex about the longitudinal axis so as to bend in the downward direction against the resilient force of the blade. The bending movement of the blade results in the simultaneously decrease of blade exposure and shaving angle.

Figure 2:
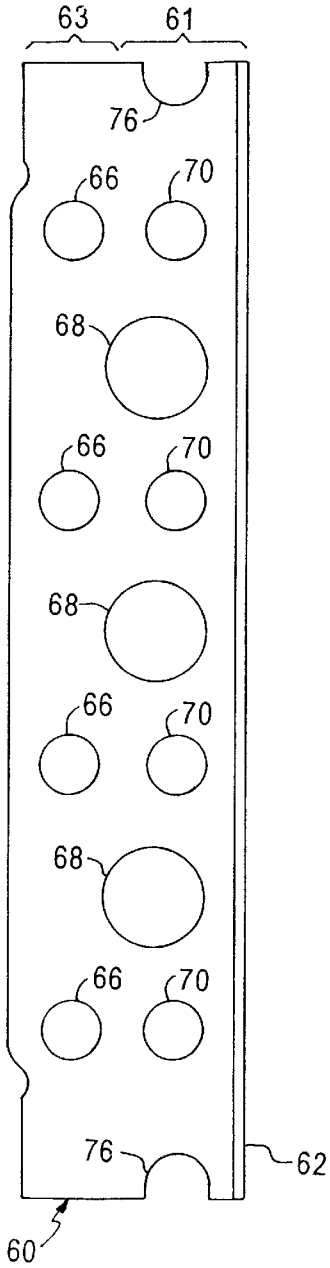
FIG. 2 illustrates a top plan view of a first embodiment of a primary blade structure of the present invention.

As depicted in FIG. 2, the first blade 60 has a forward section 61 and a rearward section 63. The first blade 60 includes securing apertures 66 which align with the securing apertures 40 of the blade seat 22 so as to allow the staking pins 142 to pass through the securing apertures 66 of the first blade 60, thereby securing the first blade 60 to the blade cartridge 10. The rearward section 63 of the first blade 60 is fixed between the upper surface 38 of the blade seat 22 and the lower surface 85 of the spacer. A portion of the forward section 61 of the first blade 60 extends beyond the upper surface 38 of the blade seat 22. The first blade 60 also includes a plurality of apertures 68 and 70 arranged at the front portion of the first blade 60 near the cutting edge 62. The first blade 60 includes a lower surface 72 and an upper surface 74, as depicted in FIG. 1.

The diameter of the holes 68 and 70 in combination with the thickness of the first blade 60 partially determines the degree of flexibility of the blade 60. These dimensions can be varied to achieve the desired degree of flexibility.

As depicted in FIG. 1, the support members 36 extend downwardly away from the upper surface 38 of the blade seat 22 so as to create a gap 42 between the lower surface 72 of the first blade 60 and the upper surface 44 of each support member 36. The gap 42 allows for the passage of water and shaving debris beneath the first blade 60 and through the slot 34 between the guard member 32 and the front wall 24.

Figure 3:
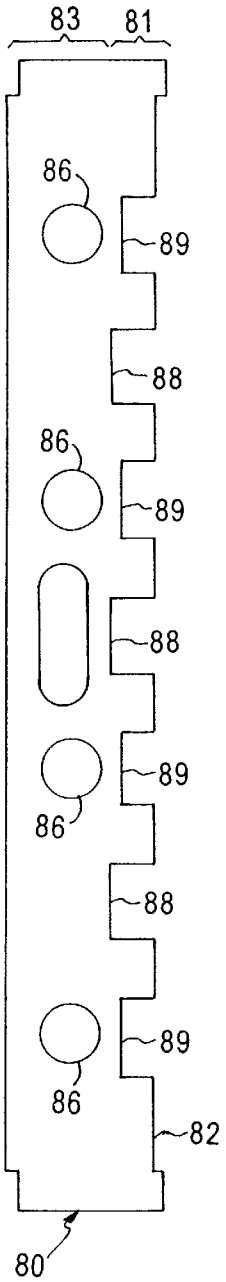
FIG. 3 illustrates a top plan view of a first embodiment of a first spacer of the present invention.

The spacer 80 functions to separate blades 60 and 90. As depicted in FIGS. 1 and 3, the spacer 80 has an upper surface 84 and a lower surface 85, and is divided into a forward section 81 and a rear section 83. The spacer 80 includes securing apertures 86 which align with the securing apertures 40 of the blade seat 22 so as to allow the staking pins 142 to pass through the securing apertures 86 of the spacer 80, thereby securing the spacer 80 to the blade cartridge 10. The forward edge 82 of the spacer includes a plurality of passages 88 and 89. In the preferred embodiment passages 88 extend slightly further towards the rear section 83 of the spacer 80 than passages 89.

Figure 4:
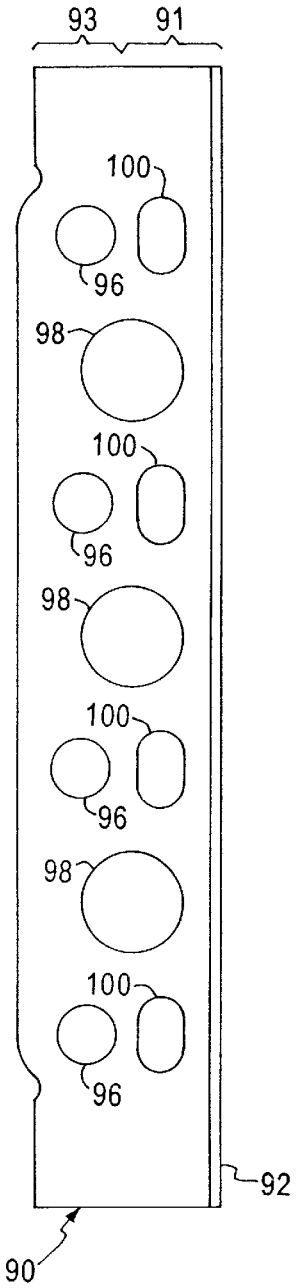
FIG. 4 illustrates a top plan view of a first embodiment of a secondary blade structure of the present invention.

The second blade 90 is illustrated in FIG. 4. The second blade 90 has a forward section 91 and a rearward section 93. Similar to the first blade 60, the second blade 90 includes securing apertures 96 which align with the securing apertures 40 of the blade seat 22 so as to allow the staking pins 142 to pass through the securing apertures 96 of the second blade 90, thereby securing the blade to the blade cartridge 10. The rearward section 93 of the second blade 90 is fixed between the upper surface 84 of the spacer 80 and lower surface 115 of the spacer 110. A portion of the forward section 91 of the second blade 90 extends beyond the upper surface 84 of the spacer 80. The second blade 90 also includes a plurality of apertures 98 and 100 arranged at the front portion 91 of the second blade 90 near the cutting edge 92. The second blade 90 includes a lower surface 102 and an upper surface 104, as depicted in FIG. 1.

As depicted in FIG. 1, an opening 46 is formed between the lower surface 102 of the second blade 90 and the upper surface 74 of the first blade 60.

Figure 5:
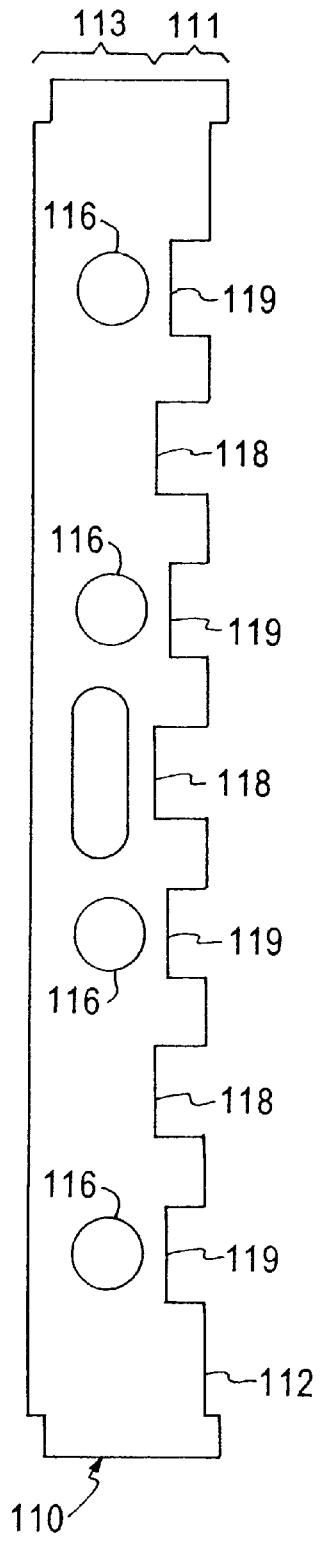
FIG. 5 illustrates a top plan view of a first embodiment of a second spacer of the present invention.

The spacer 110 functions to separate blades 90 and 120. As depicted in FIGS. 1 and 5, the spacer 110 has an upper surface 114 and a lower surface 115, and is divided into a forward section 111 and a rear section 113. The spacer 110 includes securing apertures 116 which align with the securing apertures 40 of the blade seat 22 so as to allow the staking pins 142 to pass through the securing apertures 116 of the spacer 110, thereby securing the spacer 110 to the blade cartridge 10. The forward edge 112 of the spacer includes a plurality of passages 118 and 119. In the preferred embodiment passages 118 extend slightly further towards the rear section 113 of the spacer 110 than passages 119.

Figure 6:
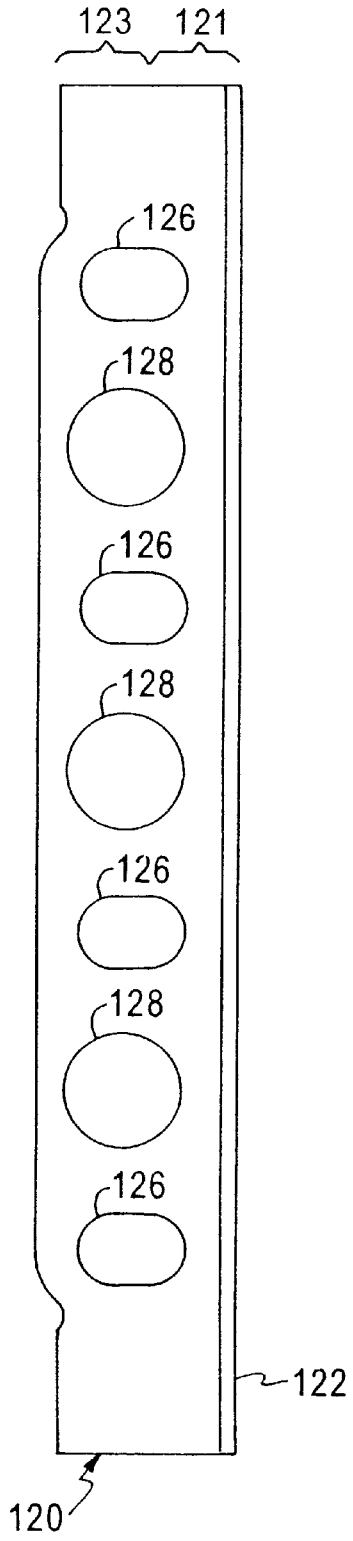
FIG. 6 illustrates a top plan view of a first embodiment of a tertiary blade structure of the present invention.

The third blade 120 is illustrated in FIG. 6. The third blade 120 has a forward section 121 and a rearward section 123. Similar to the first blade 60 and the second blade 90, the third blade 120 includes securing apertures 126 which align with the securing apertures 40 of the blade seat 22 so as to allow the staking pins 142 to pass through the securing apertures 126 of the third blade 120, thereby securing the blade to the blade cartridge 10. In the preferred embodiment of the present invention the forward section 121 of the third blade 120 proximate the cutting edge 122 thereof extends slightly beyond the upper surface 114 of spacer 110. The rearward section 123 is fixed between the upper surface 114 of the spacer 110 and the cap member 140. The third blade 120 also includes a plurality of holes or apertures 128 and the forward portions of 126, which allow for flow therethrough. The third blade 120 has a lower surface 132 and an upper surface 134, as depicted in FIG. 1.

The lower surface 132 of the third blade 120 and the upper surface 104 of the second blade 90 define a flow channel or gap 48. The gap 48 allows the passage of water and shaving debris between the second blade 90 and third blade 120.

The blades of the present invention are positioned within the blade cartridge 10 beginning with the lower surface 72 of the first blade 60 being disposed on the upper surface 38 of the blade seat 22. The lower surface 85 of the spacer 80 is disposed on the upper surface 74 of the first blade 60. The lower surface 102 of the second blade 90 is disposed on the upper surface 84 of the spacer 80. The spacer 80 exhibits a uniform height so that when the blades 60 and 90 are secured to the upper surface 84 and lower surface 85 of the spacer 80, respectively, such that the blades 60 and 90 are parallel to one another. The lower surface 115 of the spacer 110 is disposed on the upper surface 104 of the second blade 90. The lower surface 132 of the third blade 120 is disposed on the upper surface 114 of the spacer 110. The spacer 110 exhibits a uniform height so that when the third blade 120 is secured to the upper surface 114 of the spacer 110, the blades 90 and 120 are parallel to one another.

FIG. 1 illustrates the alignment of the first blade 60, the spacer 80, the second blade 90, the spacer 110, and the third blade 120. As depicted the cutting edge 62 of the first blade 60 is located forward of the cutting edge 92 of the second blade 90 which is located forward of the cutting edge 122 of the third blade 120.

Figure 7:
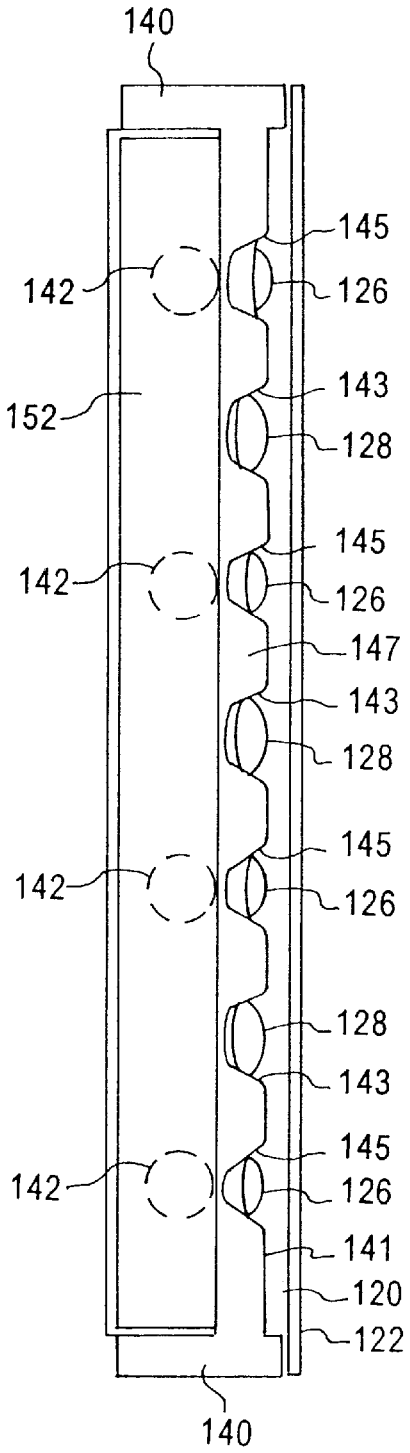
FIG. 7 illustrates a top view of the assembled cap member and tertiary blade of the present invention illustrating the lubricating agent flow paths to the cap structure.
Figure 8:
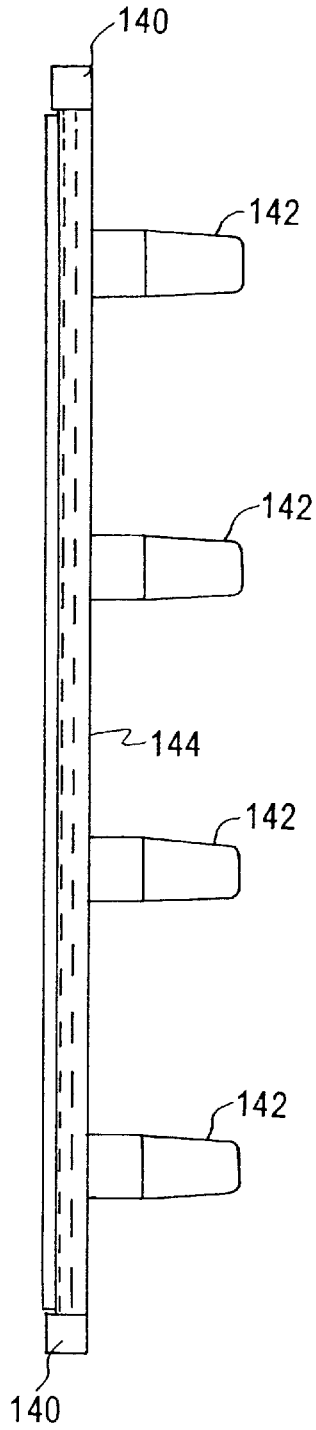
FIG. 8 illustrates a front view of a cap member of the present invention.

An embodiment of the cap member 140 of the present invention is illustrated in FIG. 7 (depicting the assembled third blade 120 and cap member 140 of the present invention) and 8 (depicting solely the cap member 140). A lower surface 144 of the cap member 140 is disposed on the upper surface 134 of the third blade 120. An upper surface 147 of the cap member 140 acts as a skin engaging surface as the blade cartridge 10 is passed over the skin of a shaver. The cap member includes a front edge 141 having passages 143 and 145 thereon. The passages 143 and 145 facilitate the free flow of lubricating agents through the flow path in the third blade 120 to the skin engaging surface 147 on the cap member 140. The cap member 140 includes a plurality of staking pins 142, such as rivets.

Referring to FIG. 1, the staking pins 142 extend downwardly from the lower surface 144 of the cap member 140 and pass through the securing apertures 126 of the third blade 120, through the securing apertures 116 of the spacer 110, through the securing apertures 96 of the second blade 90, through the securing apertures 86 of the spacer 80, through the securing apertures 66 of the first blade 60, and into the securing apertures 40 of the blade seat 22. The ends of the staking pins 142 extend beyond the blade seat 22 and are upset thereby permanently affixing the blade seat 22, blades 60, 90, and 120, spacers 80 and 110, and cap member 140 together. The third blade 120 extends beyond the lower surface 144 of the cap member 140, and therefore the cap member 140 operates as a stop limiting the upward movement of the third blade 120.

FIG. 1 illustrates in detail the novel structure of the blade cartridge 10 of the present invention. As is apparent, the first blade 60 is disposed on the upper surface 38 of the blade seat 22 with the cutting edge 62 extending over the slot 34 between the guard member 32 and the front wall 24 of the blade seat 22. The width of the blade seat 22 (i.e. the distance between the front wall 24 and rear wall 26) and the width of the first blade 60 are such that a portion of the first blade 60 extends over the slot 34. The application of force upon the first blade 60 causes the first blade 60 to flex about the longitudinal axis in a downwardly direction. The resiliency of the first blade 60 returns the blade to the normal, horizontal position (as depicted in FIG. 1) upon removal of the applied shaving force.

The second blade 90 is disposed on the upper surface 84 of the spacer 80 with the cutting edge 92 extending over the opening 46 created between the first blade 60 and the second blade 90. Similar to the first blade 60, the width of the spacer 80 and the width of the second blade 90 are such that a portion of the second blade 90 extends over the opening 46. The application of force upon the second blade 90 causes the second blade 90 to flex about the longitudinal axis in a downwardly direction. The resiliency of the second blade 90 returns the blade to the normal, horizontal position (as depicted in FIG. 1) upon removal of the applied shaving force.

The third blade 120 is disposed on the upper surface 114 of the spacer 110 with the cutting edge 112 extending over the opening 48 created between the second blade 90 and the third blade 120. Similar to the first blade 60, the width of the spacer 110 and the width of the third blade 120 are such that a portion of the third blade 120 extends over the opening 48. The application of force upon the third blade 120 causes the third blade 120 to flex slightly about the longitudinal axis in a downwardly direction. The resiliency of the third blade 120 returns the blade to the normal, horizontal position (as depicted in FIG. 1) upon removal of the applied shaving force.

It will be appreciated that as the portion of the first, second, and third blades 60, 90, and 120 extending over their respective openings is reduced, the flexibility of the blade will also be reduced. The flexibility of each blade depends upon factors including (1) the amount of overhang of the cutting edge (the distance the blade extends beyond the surface beneath the lower surface of the blade), (2) the thickness of the blade, and (3) the dimensions of the various apertures in the blades. These factors can be adjusted so that the blades 60, 90, and 120 flex when the applied force exceeds a predetermined level.

In order to prevent the corners of the blades 60, 90, and 120 from engaging the skin of the user, end clips 146 cover the outer edges of the first, second, and third blades 60, 90, and 120. As depicted in FIG. 1, each end clip 146 is located over the ends of the cap member 140. The end clips 146 are either integrally molded with the cap member 140 or they are preferably separate pieces affixed to the cap member 140 and blade cartridge 10.

As a result of mounting the blades 60, 90, and 120 in accordance with the present invention, there is no longitudinal movement of any of the blades 60, 90, and 120 relative to the remainder of the blade cartridge 10. Only rotational movement about the longitudinal axis associated with the each blade 60, 90, and 120 is possible, if so desired by constructing with sufficient overhang. Furthermore, the blades 60, 90, and 120 flex independently of one another. For example, if the pressure encountered by the first blade 60 exceeds the resilient force of the first blade 60, the first blade 60 bends in response to that force. Specifically, the first blade 60 bends about the longitudinal axis thereof, thereby causing the cutting edge 62 to move in a downward manner. Upon removal of the force, the first blade 60 would return to the horizontal position as depicted in FIG. 1. If an equivalent force were applied to either the second blade 90 or the third blade 120, they would respond in a similar manner. Thus, the cutting edges 62, 92, and 122 of the blades 60, 90, and 120 move downwardly away from the shaving plane and adjust to a lower, safer shaving angle and blade exposure.

As illustrated in FIG. 1, the guard member 32 placed in front of the first blade 60 is integral with the ends 28 and 30 of the platform member 20 and is therefore stationary relative to the blade cartridge 10. The guard 32 being positioned in front of the first blade 60 has a raised skin engaging portion 33, which provides an engaging surface to control exposure of the first blade 60 to the shaver's skin.

Numerous variations of the blades 60, 90, and 120 are possible to further enhance the flexibility of the blades. For example, each blade 60, 90, and 120 may be tapered such that the thickness of the blade decreases in the direction of the forward portion of the blade. Also, each blade 60, 90, and 120 can comprise a U-shaped channel (see 76 in FIG. 2 for the first blade 60) in the forward portion of the blades, which functions to define flexing zones for the blade 60, 90, and 120. Finally, additional holes can be added to the blades of the preferred embodiment to vary the flexibility of the blades 60, 90, and 120.

In another variation, the guard member 32 may include means to allow independent movement of the guard member 32 in the direction away from the direction of shaving forces acting upon the guard member 32. Jacobson U.S. Pat. Nos. 4,442,598, 4,378,634 and 4,270,268 disclose a blade cartridge having movable guard means.

Similarly, the cap member 140 may include means to allow independent movement in a direction away from the direction of shaving forces acting upon the cap member 140. Oldroyd et al., U.S. Pat. No. 4,063,354, discloses a shaving unit having a movable cap member 140 suitable for use with this invention.

In yet another variation, a shaving aid or lubrication applicator 150 may be affixed or included with the blade cartridge 10. Typically, as depicted in FIG. 1, the shaving aid 150 comprises a polystyrene-polyethylene oxide blend in the form of lubricating strip 152, which may affixed to the upper surface 148 of the cap member 140 behind the third blade 120. During shaving, the polyethylene oxide bleaches out of the styrene matrix. The cap member 140 may have a molded lube strip 152 glued on or the lube strip 152 may be molded onto the cap member 140 in a second shot. Other suitable shaving aids for use with the invention are also described in U.S. Pat. No. 4,170,821 issued to Booth entitled "Razor Cartridges." Preferably, the shaving aid 150 comprises a matrix of polystyrene, polyethylene oxide and aloe and/or vitamin E.

In yet a further variation, the blade cartridge 10 may be permanently or detachably connected to a handle by suitable structures formed on the bottom surface of the blade cartridge 10. For example, the bottom surface of the blade cartridge 10 can be formed so as to attach to a handle in the manner described in U.S. Pat. No. 4,833,779 entitled PLATFORM, HANDLE AND SHIELD FOR SAFETY RAZOR, which issued to C. Iten and is hereby incorporated by reference.

Alternatively, the blade cartridge 10 can be mounted on a handle in such a manner that it pivots or is stationary while it is used to shave a surface. For example, as illustrated in FIG. 1, the bottom surface of the platform member 20 includes a mounting device 50 that allow the blade cartridge 10 to be pivotally and detachably mounted to a handle. The mounting device 50 includes a pair of mounting members 52 with attaching hooks 54 on the terminal end thereof. The mounting device 50 further includes an arcuate pivot rail 56 and a centering cam 58.

The blade cartridge 10 of the present invention is constructed such that the cartridge pivots about an axis 12. The pivot axis 12 is positioned towards the rear of the cartridge 10 behind the midpoint between the guard member 32 and the cap member 140. As depicted in FIG. 1, the pivot axis 12 of the blade cartridge 10 having three blades is positioned adjacent the third blade 120.

Still further, it is within the spirit of this invention to detachably connect the blade cartridge 10 to a handle, such as in U.S. Pat. No. 4,026,016 entitled RAZOR BLADE ASSEMBLY, issued to Warren I. Nissen, which is incorporated herein by reference.

A novel feature of the present invention is the addition of flow paths running through the blade cartridge 10 that supply lubricant to successive skin engaging edges or surfaces. Typically shavers use some type of lubricating agent on the surface of their skin, such as shaving cream or gel containing emollients, moisturizers, surfactants, wetting agents, thickeners, and film formers, to reduce the amount of irritation to the skin caused by the razor blade cartridge 10 being repeatedly pulled across the skin of the shaver. As the razor blade cartridge 10 is pulled across the skin the skin engaging edges or blades and other skin engaging surfaces strip the lubricating agents from the skin and leave the skin vulnerable to irritation from successive edges or surfaces of the blade cartridge 10.

Figure 10:
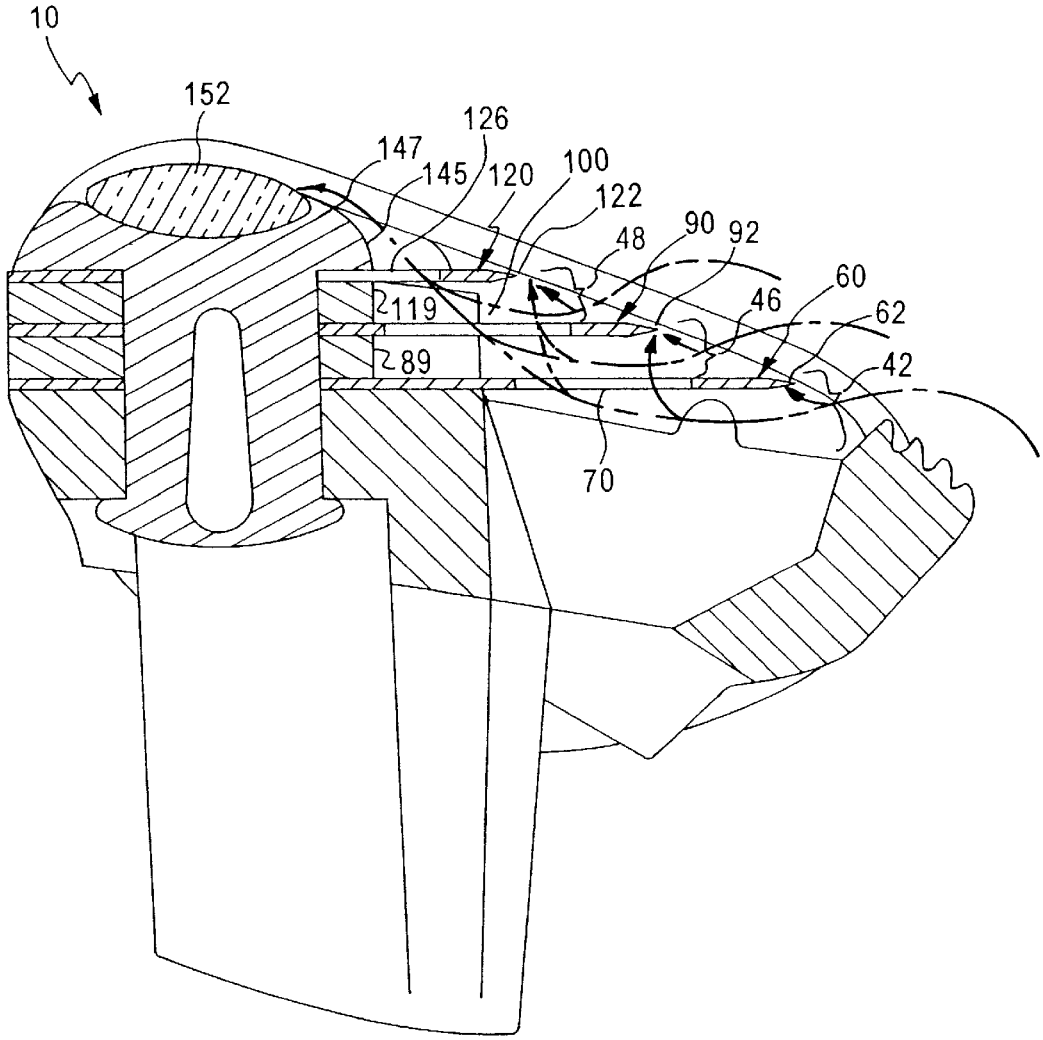
FIG. 10 illustrates a cross-sectional view of the razor blade cartridge of the present invention through a rivet on the cap member illustrating several moisture and lubricant flow paths through the cartridge.

FIG. 10 depicts the flow of lubricant through the various flow paths in the blade cartridge 10 of the present invention. As depicted in FIGS. 2 and 10, the first blade 60 includes apertures 68 and 70 that define a flow path through the first blade 60. Similarly, as depicted in FIGS. 4 and 10, the second blade 90 includes apertures 98 and 100 that define a flow path through the second blade 90. And, as depicted in FIGS. 6 and 10, the third blade 120 includes apertures 126 and 128 that define a flow path through the third blade 120.

Spacer 80, as depicted in FIGS. 3 and 10, includes passages 88 and 89 that correspond to apertures 68 and 70, respectively, in the first blade 60 and apertures 98 and 100, respectively, in the second blade. The passages 88 and 89 abut the flow paths through the first blade 60 and through the second blade 90, and allow the agents to freely flow through those flow paths. Spacer 110, as depicted in FIGS. 5 and 10, also includes passages 118 and 119 that correspond to apertures 98 and 100, respectively, in the second blade and apertures 128 and 126, respectively, in the third blade 120. The passages 118 and 119 abut the flow paths through the second blade 90 and through the third blade 120, and allow the agents to freely flow through those flow paths. Cap member 140, as depicted in FIGS. 7 and 10, includes passages 143 and 145 that correspond to apertures 128 and 126, respectively, in the third blade 120. The passages 143 and 145 abut the flow paths through the third blade 120, and allow the agents to freely flow through this flow path. The passages 88, 89, 118, 119, 143, and 145 can be configured using numerous shapes, for example as recesses or indentations (as depicted in the figures) or as apertures through their respective members.

As depicted in FIG. 10, agents removed from the skin of the shaver by the cutting edges 62, 92, and 122 can flow in through gaps 42, 46, and 48. The materials are then free to travel through the flow paths in the first blade 60, the second blade 90, and the third blade 120. The material travelling through the gap 42 beneath the first blade 60 then travels through the flow path in the first blade 60. The material travelling through the flow path in the first blade 60 joins with material travelling through the gap 46 beneath the second blade 90 and supplies lubricant to the cutting edge 92 of the second blade. The material then travels through the flow path in the second blade 90. The material travelling through the flow path in the second blade 90 joins with material travelling through the gap 48 beneath the third blade 120 and supplies lubricant to the cutting edge 122 of the third blade. The material then travels through the flow path in the third blade 120 and supplies lubricant to the skin engaging surface 147 on the cap member 140 and moisture to the lubricating strip 152.

Figure 11:
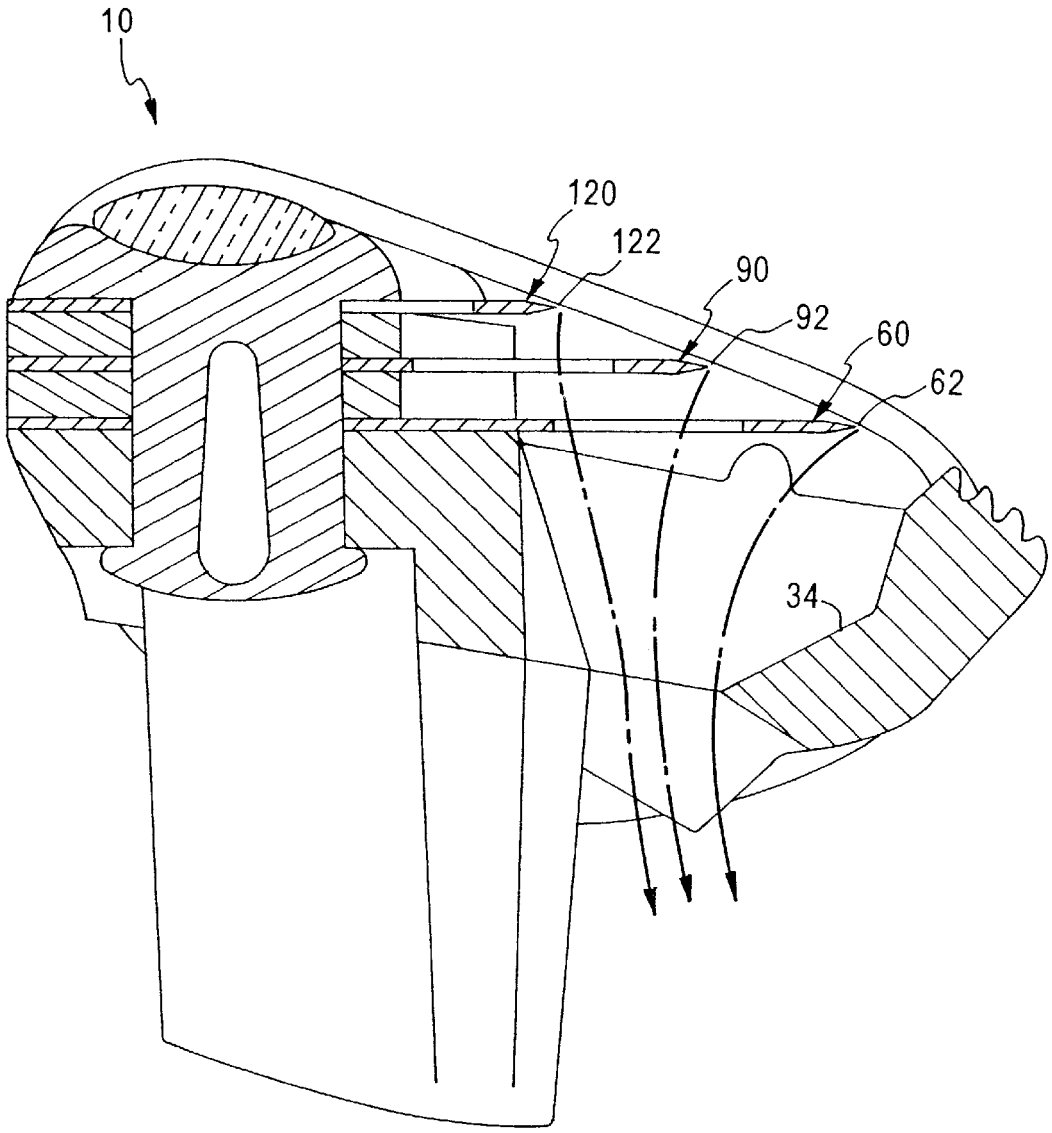
FIG. 11 illustrates a cross-sectional view of the razor blade cartridge of the present invention through a rivet on the cap member illustrating a debris flow path through the cartridge.

FIG. 11 depicts a cross-sectional view of the razor blade cartridge 10 of the present invention illustrating a debris flow path through the cartridge. The flow paths through the blades can act in conjunction with flow channel 34 to provide a path for excess debris and lubricating agents to exit the blade cartridge 10.

Figure 12:
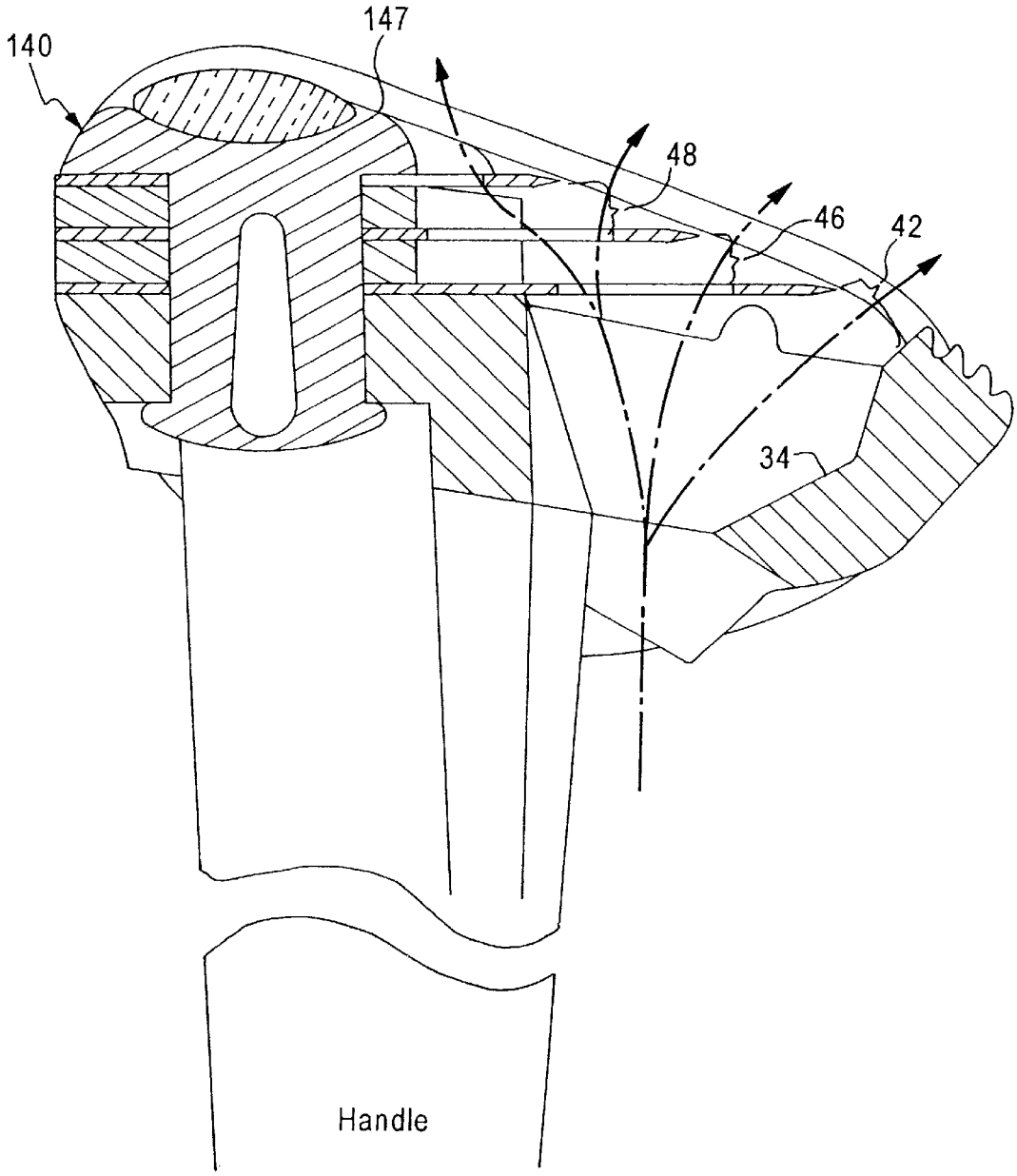
FIG. 12 illustrates a cross-sectional view of the razor blade cartridge of the present invention through a rivet on the cap member illustrating a rinse flow path through the cartridge.

FIG. 12 depicts a cross-sectional view of the razor blade cartridge 10 of the present invention illustrating a rinse path through the cartridge. The flow paths through the blades can act in conjunction with flow channel 34 to provide a path for expelling the debris from within the blade cartridge 10. A stream of water directed through the bottom of the flow channel 34 and up through the flow paths in the blades can expel debris out the gaps 42, 46, and 48 and out passed the skin engaging surface 147 of the cap member 140.

In its most basic form, the present invention can be constructed with a single blade having and aperture defining a flow path for transporting lubrication removed from a surface of a shaver by a skin engaging edge of the blade and supplying the lubrication to a skin engaging surface of the cap member. The blade is mounted between a cap member and a platform member. In this embodiment no spacer is needed.

The embodiments described above provide a number of significant advantages. The present invention provides a blade cartridge arrangement including blades having apertures. The apertures in the blades define flow paths that allow lubricants to reach successive cutting edges or skin engaging surfaces, thereby reducing irritation to the shaver. The blades are spaced apart by spacers that are constructed with passages that allow the free flow of lubricant through adjacent flow paths. This arrangement is especially significant for razor blade cartridges having three blades, where, in conventional razor blade cartridges, the third blade and cap member are likely to encounter dry skin even on the initial pass of the cartridge over the skin. Such a blade cartridge will not only improve comfort and reduce irritation of the skin of the shaver from contact with skin engaging surfaces of the cartridge, but will enhance the performance of lubricating strips positioned on the cap member by supplying moisture to those strips and thereby releasing the lubricating substances therefrom.

As yet another advantage, the blade cartridge of the present invention provides a blade that is flexible about the longitudinal axis of the blade within a body portion of a blade cartridge precisely controls blade geometry in response to shaving forces. Any flexing of the blade results in the simultaneous reduction of critical safety dimensions, blade exposure and shaving angle.

Of course, it should be understood that a wide range of changes and modifications could be made to the preferred embodiment described above. It is therefore intended that the present invention is not limited to the embodiments described above, but encompasses any and all embodiments within the scope of the following claims, and equivalents thereof.

What is claimed is:

1. A razor blade cartridge comprising:

a platform member having a blade seat;

a blade disposed on said blade seat, said blade having a skin engaging edge; and a cap member disposed on said blade, said cap member including:

a skin engaging surface;

a front edge;

a lower surface;

a rear edge, and an indentation formed in said front edge that creates an opening in said skin engaging surface to define a passage formed through said skin engaging surface;

wherein said blade includes an aperture aligned with said passage to define a flow path for transporting lubrication removed from a surface of a shaver by said skin engaging edge of said blade and supplying the lubrication to said skin engaging surface of said cap member by way of said passage of said cap member.

2. The razor blade cartridge according to claim 1 wherein said blade has a forward section that is flexible about a longitudinal axis of said blade in response to applied shaving forces.

3. The razor blade cartridge according to claim 1 wherein said platform member includes a guard member disposed forward of said blade seat so as to form a slot between said blade seat and said guard member.

4. The razor blade cartridge according to claim 1 further comprising a lubrication member affixed to said cap member.

5. The razor blade cartridge of claim 1 wherein said blade has a forward section, said aperture being located at said forward section of said blade.

6. The razor blade cartridge of claim 1 wherein said blade has a rearward section permanently fixed between said platform member and said cap member.

7. The razor blade cartridge according to claim 1 further comprising a pair of opposing mounting members attached to said platform member, each of said pair of opposing mounting members having an attaching hook adapted for connection to a handle.

8. The razor blade cartridge according to claim 7 wherein:

said platform member includes a guard member disposed forward of said blade seat, and said blade cartridge having a curved surface adapted to abut and be slidably related to a portion of the handle, said curved surface defining a pivot connection allowing said blade cartridge to pivot about the handle in response to shaving forces, said pivot connection having a pivot axis located rearward of a midpoint between said guard member and said cap member.

9. The razor blade cartridge according to claim 1 wherein said indentation formed in said front edge of said cap member overlaps with said aperture in said blade.

10. A razor blade cartridge comprising:

a platform member having a blade seat and a guard member;

a first blade disposed on said blade seat, said first blade having a cutting edge located rearwardly of said guard member;

a spacer disposed on said first blade;

a second blade disposed in a first plane on said spacer, said second blade having a cutting edge located rearwardly of said cutting edge of said first blade;

a cap member disposed on said second blade, said cap member including:

a skin engaging surface;

a front edge;

a lower surface;

a rear edge, and a passage formed in said front edge that is substantially perpendicular to the first plane;

wherein said second blade includes an aperture aligned with said passage to define a flow path for transporting lubrication removed from a surface of a shaver by said second blade and supplying the lubrication to said skin engaging surface of said cap member by way of said passage of said cap member.

11. The razor blade cartridge according to claim 10 wherein said first blade includes an aperture defining a flow path for transporting lubrication removed from the surface of the shaver by said first blade and supplying the lubrication to said cutting edge of said second blade.

12. The razor blade cartridge according to claim 11 wherein said flow path defined by said aperture in said first blade is generally aligned with said flow path defined by said aperture in said second blade thereby defining a continuous flow path.

13. The razor blade cartridge according to claim 11 wherein said spacer has a passage along a forward section thereof, said passage allowing lubrication to flow through said flow path defined by said aperture in said first blade and allowing lubrication to flow through said flow path defined by said aperture in said second blade.

14. The razor blade cartridge according to claim 13 wherein said flow path defined by said aperture in said first blade is generally aligned with said flow path defined by said aperture in said second blade thereby defining a continuous flow path, and wherein said passage of said spacer generally aligns with said continuous flow path.

15. The razor blade cartridge according to claim 10 wherein said first blade and said second blade have a forward section that is flexible about a longitudinal axis of said first blade and said second blade, respectively, in response to applied shaving forces.

16. The razor blade cartridge according to claim 10 wherein said guard member is disposed forward of said blade seat so as to form a slot between said blade seat and said guard member.

17. The razor blade cartridge according to claim 10 further comprising a lubrication member affixed to said cap member.

18. The razor blade cartridge of claim 10 wherein said first blade has a forward section, with an aperture , and wherein said second blade has a forward section, said aperture of said second blade being located at said forward section of said second blade.

19. The razor blade cartridge of claim 10 wherein said first blade and said second blade have a rearward section permanently fixed between said platform member and said cap member.

20. The razor blade cartridge according to claim 10, further comprising:

a handle attached to said razor blade cartridge.

21. The shaving apparatus according to claim 20, wherein:

the razor blade cartridge is detachably attached to the handle.

22. The shaving apparatus according to claim 20, wherein:

the razor blade cartridge is pivotally attached to the handle.

23. The shaving apparatus according to claim 20, wherein:

the razor blade cartridge is pivotally and detachably attached to the handle.

24. A razor blade cartridge comprising:

a platform member having a blade seat and a guard member;

a first blade disposed on said blade seat, said first blade having a cutting edge located rearwardly of said guard member;

a first spacer disposed on said first blade;

a second blade disposed on said first spacer, said second blade having a cutting edge located rearwardly of said cutting edge of said first blade;

a second spacer disposed on said first blade;

a third blade disposed in a first plane on said second spacer, said third blade having a cutting edge located rearwardly of said cutting edge of said second blade; and a cap member disposed on said third blade, said cap member including:

a skin engaging surface;

a front edge;

a lower surface;

a rear edge, and a passage formed in said front edge that is substantially perpendicular to said first plane;

wherein said first blade includes an aperture defining a flow path for transporting lubrication removed from a surface of a shaver by said first blade and supplying the lubrication to said cutting edge of said second blade, wherein said second blade includes an aperture defining a flow path for transporting lubrication removed from the surface of the shaver by said second blade and supplying the lubrication to said cutting edge of said third blade, and wherein said third blade includes an aperture aligned with said passage to define a flow path for transporting lubrication removed from the surface of the shaver by said third blade and supplying the lubrication to said skin engaging surface of said cap member by way of said passage of said cap member.

25. A shaving apparatus comprising:

a razor blade cartridge comprising:

a platform member having a blade seat and a guard member;

a first blade disposed on said blade seat, said first blade having a cutting edge located rearwardly of said guard member;

a spacer disposed on said first blade;

a second blade disposed in a first plane on said spacer, said second blade having a cutting edge located rearwardly of said cutting edge of said first blade;

a cap member disposed on said second blade, said cap member including:

a skin engaging surface;

a front edge;

a lower surface;

a rear edge, and a passage formed in said front edge that is substantially perpendicular to the first plane;

wherein said second blade includes an aperture aligned with said passage to define a flow path for transporting lubrication removed from a surface of a shaver by said second blade and supplying the lubrication to said skin engaging surface of said cap member by way of said passage of said cap member; and a handle attached to the razor blade cartridge.

26. A shaving apparatus comprising:

a razor blade cartridge comprising:

a platform member having a blade seat and a guard member;

a first blade disposed on said blade seat, said first blade having a cutting edge located rearwardly of said guard member;

a first spacer disposed on said first blade;

a second blade disposed on said first spacer, said second blade having a cutting edge located rearwardly of said cutting edge of said first blade;

a second spacer disposed on said first blade;

a third blade disposed in a first plane on said second spacer, said third blade having a cutting edge located rearwardly of said cutting edge of said second blade; and a cap member disposed on said third blade, said cap member including:

a skin engaging surface;

a front edge;

a lower surface;

a rear edge, and a passage formed in said front edge that is substantially perpendicular to said first plane;

wherein said first blade includes an aperture defining a flow path for transporting lubrication removed from a surface of a shaver by said first blade and supplying the lubrication to said cutting edge of said second blade, wherein said second blade includes an aperture defining a flow path for transporting lubrication removed from the surface of the shaver by said second blade and supplying the lubrication to said cutting edge of said third blade, and wherein said third blade includes an aperture aligned with said passage to define a flow path for transporting lubrication removed from the surface of the shaver by said third blade and supplying the lubrication to said skin engaging surface of said cap member by way of said passage of said cap member; and a handle attached to the razor blade cartridge.

* * * * *